United States Patent [19]

Stankovic

[11] Patent Number: 4,775,146

[45] Date of Patent: Oct. 4, 1988

[54] MULTIFUNCTION PHYSICAL FITNESS APPARATUS

[76] Inventor: Gus Stankovic, 2377 N. 47th St., Milwaukee, Wis. 53210

[21] Appl. No.: 33,527

[22] Filed: Apr. 3, 1987

[51] Int. Cl.[4] ..... A63B 21/06

[52] U.S. Cl. ..... 272/118

[58] Field of Search ..... 272/117, 118, 134, 93, 272/DIG. 4

[56] References Cited

U.S. PATENT DOCUMENTS

| | | | |
|---|---|---|---|
| 2,977,120 | 3/1961 | Morris | 272/118 |
| 3,627,315 | 12/1971 | Marcyan | 272/118 |
| 3,741,538 | 6/1973 | Lewis et al. | 272/134 |
| 4,358,108 | 11/1982 | Voris | 272/134 X |
| 4,632,388 | 12/1986 | Schleffendorf | 272/117 X |
| 4,635,926 | 1/1987 | Minkow | 272/118 |
| 4,637,608 | 1/1987 | Owens et al. | 272/134 |

OTHER PUBLICATIONS

Advertisement for "Marcy's 7 Man Master Gym", in Marcy catalog, pp. 10–11, 1974.

Advertisement for "Free Standing High/Low Pulley", in Universal catalog, 1981.

*Primary Examiner*—Richard J. Apley
*Assistant Examiner*—Robert D. Bahr
*Attorney, Agent, or Firm*—Fuller, Puerner & Hohenfeldt

[57] ABSTRACT

A multifunction physical fitness machine has two similar generally rectangular frames standing upright in laterally spaced apart relation to define the narrow ends of a rectangular floor area for usually one but possibly three exercising persons. Each frame contains a stack of weights which are constrained to move vertically only and there is a pulley and cable system for an exerciser to lift the weights. A third rectangular frame stands upright on a laterally and vertically extending plane that is coincident with the long rear side of said rectangular area. The third frame is fixed midway between the two end frames and these frames have stacks of weights and pulley and cable systems for an exerciser to lift the weights. Structural members tie all three frames together at their upper ends.

2 Claims, 2 Drawing Sheets

MULTIFUNCTION PHYSICAL FITNESS APPARATUS

BACKGROUND OF THE INVENTION

This invention pertains to apparatus for stressing body muscles for the purpose of exercise and improving physical fitness.

Persons who are engaged in a serious fitness improvement program usually require several pieces of apparatus to stress all of the major muscles in the body and develop them to peak condition. An exercise schedule typically involves rowing, pullovers, shrugs, bench presses, lateral raises, rear and front deltoid raises, reverse arm raises, bicep curls, tricep extensions, squats, calf raises and crossovers. Professionals and serious amateurs usually use apparatus of the type in which there are stacks of weights that can be selectively connected to a carrier which is lifted upwardly in guides mounted in an upright frame that stands on the floor and allows the user to lift the weights by imposing a tensile force on the cable in a cable and pulley system.

Usually several pieces of apparatus based on weights that are lifted through a cable and pulley system are required to exercise and develop the major muscles of the body. For example, one exercise is to do crossovers. Conventional apparatus for crossovers requires two rather distantly spaced apart upright weight guiding frames. Each of the frames stands on the floor and they are tied together at their upper ends by laterally extending members. The structure may also be clamped to a wall. In the crossover routine, the exerciser will grip the handle that is pendulating on the end portion of the weight lifting cable associated with each of the frames. Initially, the arms are extended to the left and right, respectively, and the weights are almost bottomed out. Then the exerciser will concurrently or consecutively swing his or her right arm across the front of the body for the right hand to end up on the left side and swing the left arm across the front of the body for the left hand to end up on the right side. This routine is used, for example, to exercise and strengthen the deltoid muscles. Another machine might be kept on hand to do latissimus dorsi (lat) pulldowns. Still another machine that is specialized for such exercises as standing and sitting rowing routines may be required. A review of the catalogs of fitness equipment manufacturers will reveal the availability of a wide variety of exercise apparatus each of which is somewhat specialized for doing a limited number of exercise routines.

Exercise and physical fitness improvement equipment is often set up in a room or in the basement of a residential dwelling where space is at a premium. It is not only necessary to find space for the individual pieces of apparatus but it is also necessary to allow some space between the apparatus so that the space problem encountered by a serious physical fitness improver can become critical.

SUMMARY OF THE INVENTION

An objective of the invention is to provide multifunction physical fitness apparatus which requires a comparatively small amount of floor area and yet allows performing all of the exercise routines that experts consider necessary for development and conditioning of all of the important body muscles.

Another important objective of the invention is to arrange several weight lifting exercise modalites into a unitary structure which not only occupies a comparatively small space but effects an economy in manufacturing because of the various modalities interacting functionally and structurally with each other as a result of their being combined with mutually supporting parts.

Briefly stated, the new exercise apparatus comprises three upright frames that are designed to stand on the floor of a building. The frames can be thought of as being arranged about the perimeter of an elongated rectangle inscribed on the floor. There is a frame at each of the narrow ends of the rectangle and these frames and the parts associated with them are like mirror images of each other. Another frame stands upright on one of the longer sides namely, the rear side of the imaginary rectangle and it is centered between the two end frames. Each of the frames has vertical guides on which a stack of heavy bars, herein called weights, are arranged for sliding up and down on guides. There is a carrier for the stack of weights. In accordance with conventional practice, a pin is provided for fastening a selected one of the weights in the stack to the carrier so that all weights above the selected weight are lifted with it and all weights below the selected weight remain at rest on springs at the bottom of the frame. Also provided, of course, are pulleys and a cable that is connected to the weight carrier. The exerciser creates tension in the cable to thereby raise the weights and stress the muscles. There are metal legs pivotally mounted near the flcor adjacent each side of the center and frame. These legs have footrests mounted to them on the ends remote from their pivots. The legs are stored substantially in vertical position and they can be swung to an approximately horizontal position wherein the footrests are presented toward the front of the apparatus in a position where they are needed for doing such exercises as rowing.

How the foregoing objectives and other more specific objectives of the invention are achieved will be evident in the ensuing detailed description of a preferred embodiment of the invention which will now be set forth in reference to the drawings.

DESCRIPTION OF A PREFERRED EMBODIMENT

Figure 2:
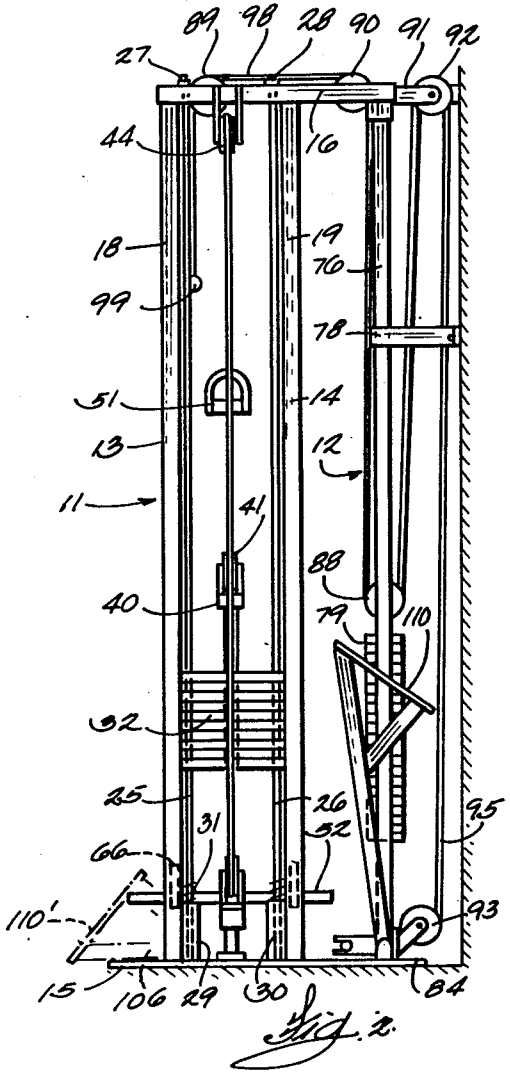
FIG. 2 is a right side elevational view of the apparatus shown in the preceding figure.
Figure 1:
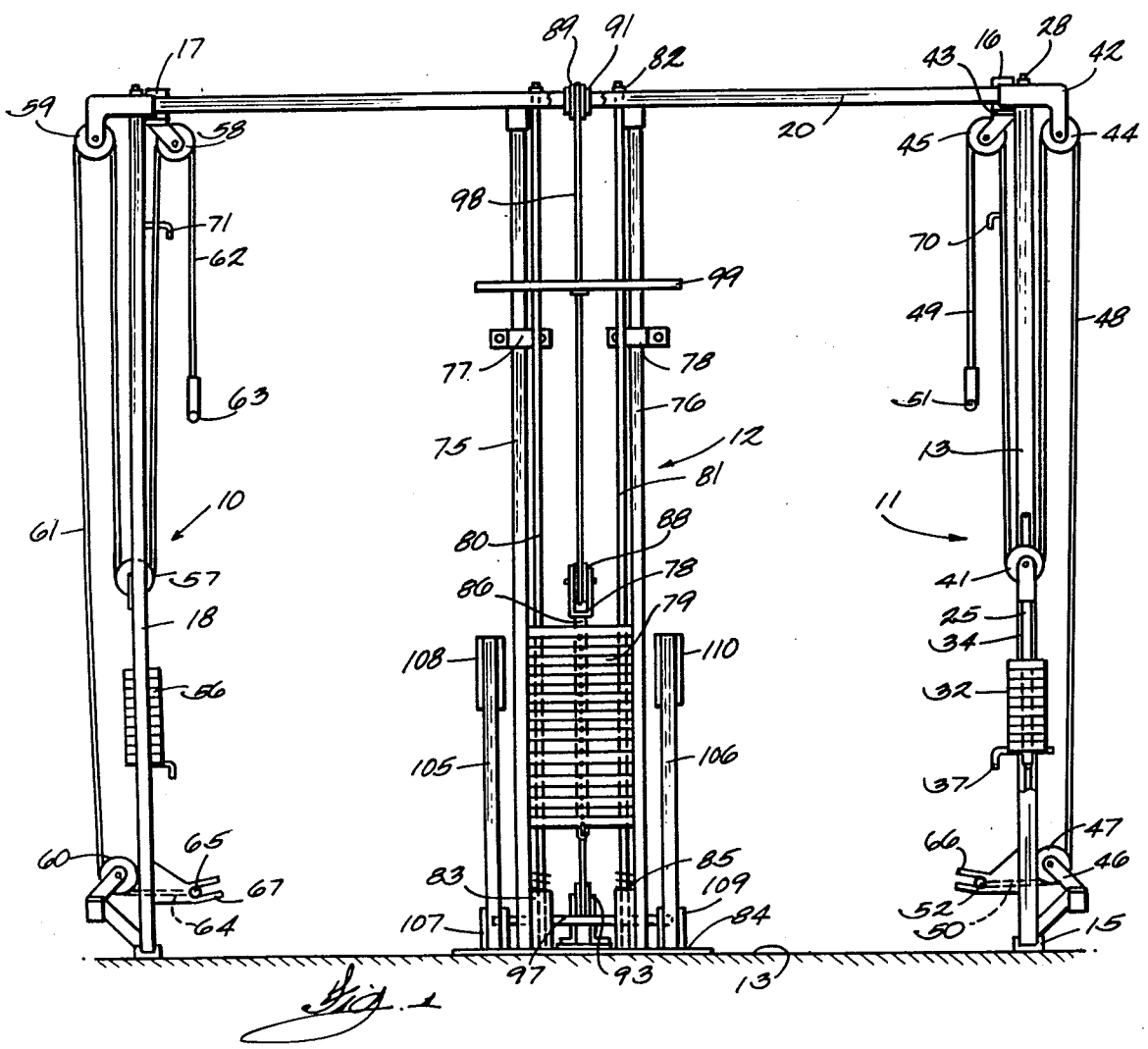
FIG. 1 is a front elevational view of the new fitness apparatus.

In FIG. 1 there are three frames, a left end frame generally designated by the numeral 10, a right end frame by the numeral 11 and a center frame by the numeral 12. The frames stand upright on the surface of a floor 13 and may be looked upon as being arranged about the perimeter of a rectangle drawn on the floor. Thus, laterally spaced apart end frames 10 and 11 stand on the narrow end sides of the rectangle and center frame 12 stands on the rear long side of the rectangle midway between end or left and right frames 10 and 11. As is most evident in FIGS. 2 and 3, center frame 11 is rearward or set back transversely of a line extending laterally between corresponding points on end frames 10 and 11.

Since the end frames are mirror images of each other, it will only be necessary to describe the right hand frame 11 and its associated parts in detail. Frame 11 is comprised of two parallel transversely spaced apart upright columns marked 13 and 14. These columns stand upright on a base plate member 15 that can be bolted to the floor 13 by anchor bolts set in the floor but are not shown. The upper ends of frame columns 13 and 14 are connected together for the sake of stability by transversely extending cross member 16. The corresponding cross member at the left frame 10 is marked 17 in FIG. 1. The column members in left frame 10 are marked 18 and 19. There are laterally extending pipes, one of which 20 is visible in FIG. 1 and the other of which 21 is visible in section in FIG. 3 along with pipe 20 which is in section. Laterally extending pipes 20 and 21 tie in with upper end cross members 16 and 17, which arrangement, in conjunction with the frames being tied into the floor, provides a very stable structure.

Typical end Frame 11 has two guide rods 25 and 26 arranged in parallelism with each other and in parallelism with column members 13 and 14. The upper ends of guide rods 25 and 26 are threaded and pass through cross member 16. The rods are secured with nuts such as those marked 27 and 28. The lower end of guide rods 25 and 26 extend to floor plate 15. The lower ends of the rods are surrounded by tubular members 29 and 30 which contain shock absorbing or bumper springs such as the one marked 31.

Figure 3:
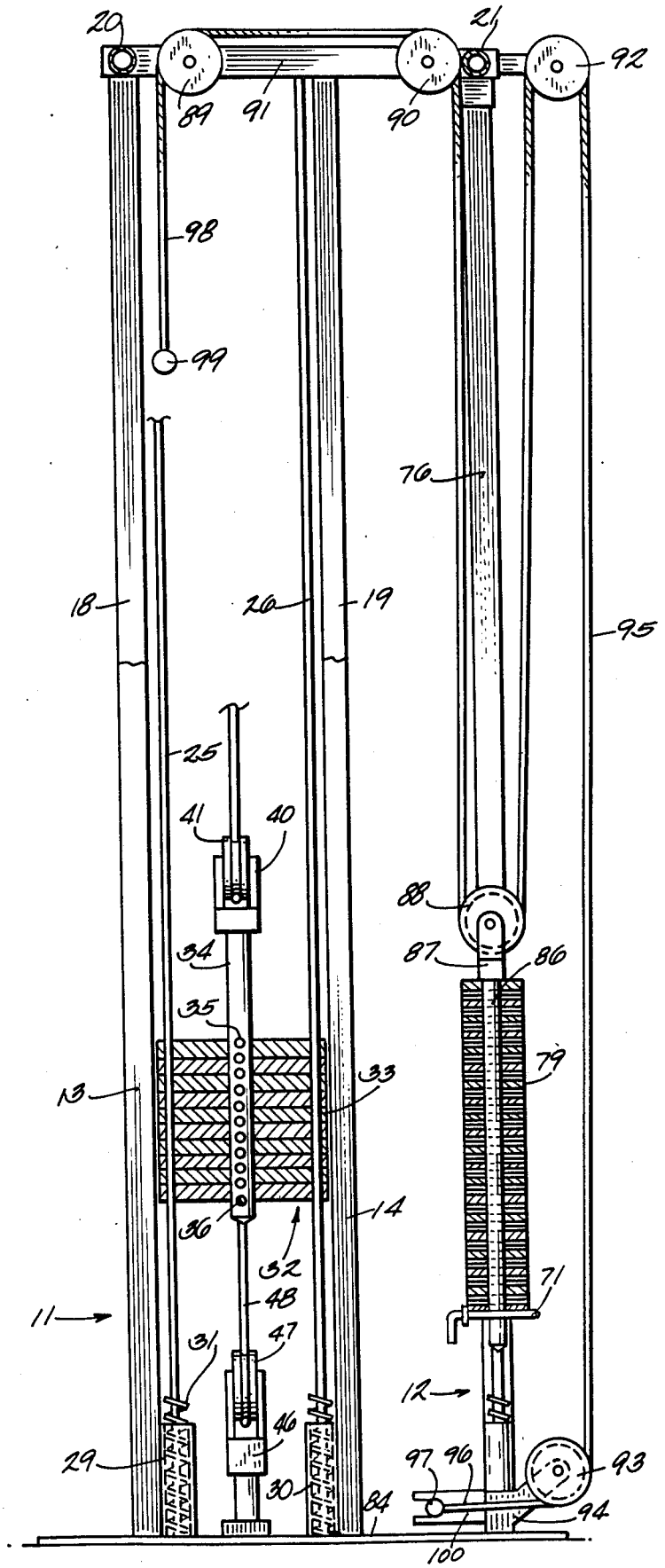
FIG. 3 is similar to FIG. 2 except that some parts are shown in section to reveal other parts and the FIG. 3 view is enlarged compared to FIG. 2.

There is a stack of metal plates constituting weights 32 which have vertically aligned holes such as the one marked 33 so they can slide on the guide rods 25 and 26. The weights also have aligned central holes through which a carrier bar 34 passes as is most evident in FIG. 3. The weights also have laterally extending holes which align with corresponding holes 35 in carrier bar 34. In FIG. 3, one may see that a straight pin 36 having a handle 37 is pushed through the lower most of the weights 32 as is the case in the drawings, all of the weights will be lifted together if a lifting force is applied to carrier bar 34. One or all of the weights may be used in any exercise routine. Selection of the number of weights which are to be lifted by the exerciser is made by putting the pin 36 through one of the holes 35 in carrier bar 34 in which case weights above the weight in which the pin is inserted will be lifted when the carrier bar 34 is lifted and weights below the pin will remain at rest on bumper springs 31

There is a clevis 40 fastened to the upper end of carrier bar 34 and a pulley 41 is mounted for rotation in this clevis. As can be seen best in FIG. 1, there are two pulley brackets 42 and 43 mounted centrally between upright members 13 and 14 near their upper ends. There are pulleys 44 and 45 supported for rotating in brackets 42 and 43. There is a bracket 46 mounted proximate to the lower ends of column members 13 and 14 and midway between them. A pulley 47 is mounted for rotation in bracket 46. There is a cable 48 running over pulleys 41, 44, 45 and 46. The cable has an upper free end portion 49 and a lower free end portion 50. The upper end portion 49 terminates in a stirrup-like handle 51 and the lower end portion terminates in a bar-like handle 52. When no tensile force is applied to the cable at either end portion 49 or 50, the weights 32 would be at their lowest position resting on the bumper springs. The weights are, however, shown in a position as if the cable were being stressed in tension such as would result in lifting the weights to the position in which they are shown.

The frame 10 at the left end of the rectangularly arranged three weight frames 10–12 also has a set of weights 56, a pulley 57 on the top of a weight carrier bar, a pair of pulleys 58 and 59 proximate to the upper ends of the column members 18 and 19, and a lower pulley 60. A cable 61 runs over these pulleys as is understandable if one simply inspects the drawings. Cable 61 has an upper free end portion 62 which terminates in a stirrup handle 63 and a lower free end portion 64 which terminates in a handle 65. Because the weight stacks 56 and 32 are shown lifted off of the bumper springs it is presumed that a downward force is being applied to stirrup like handles 51 and 63 and to their adjacent cable end portions 49 and 62. To make it possible to lift the stack of weights by pulling downwardly on handles 51 and 63, it is necessary to prevent the cables from simply being pulled off of their pulleys. One cable end always has to be anchored. Thus, as shown at the bottom end of right end frame 11, the handle 52 on the cable is allowed to pull into the space between a pair of prongs 66 and come to a stop. Now all of the vertical force applied to handle 51 will cause the cable loop running around carrier pulley 41 to shorten and the end portion 49 of the cable extending beyond upper pulley 45 to lengthen as the weights are lifted. The left frame 10 is also provided with a bracket at its lower end which has spaced apart prongs 67 between which handle 65 is pulled and blocked when a downward force is applied to handle 63.

When the apparatus is used in a manner that requires applying a pulling force on lower left and right handles 52 and 65 singly or together, it is necessary to fasten the opposite free end portions 49 and 62 of the cables in the respective frames 11 and 10. In this case, the stirrups 51 and 53 are allowed to become hooked on some hooks such as the one marked 70 on frame 11 and the one marked 71 on the frame 10. Now, it would be possible to apply a tension force to the cables through the agency of lower handles 52 and 65 that would cause the weights to be lifted.

It should be observed that one exercising individual could have the described multifunction fitness apparatus all to himself. However, it is also possible for three individuals to use the apparatus at the same time. One of the individuals could use the left frame 10 weights and do exercises that stress muscles in different ways by pulling or pushing on either a lower handle 65 or the upper handle 63. Another individual could at the same time use the weights on frame 11. Furthermore, a third individual could perform various exercises with the weights on frame 12.

Frame 12 is structurally similar to end frames 10 and 11 but it is arranged differently. Frame 12 comprises two upright laterally spaced apart column members 75 and 76. They tie in at their upper ends to one of the laterally extending tubular members 21 which tie frames 10 and 11 together at their upper ends. The apparatus can be fastened to the wall of a room with clamping brackets 77, 78, for example, or other suitable means. Column members 75 and 76 lie in a vertically and laterally extending plane to which the planes of end frames 10 and 11 are perpendicular. In other words, frame 12 stands at the rear of the imaginary rectangle on the floor which defines the exercise area as mentioned earlier. There is a stack of weights 79 within the frame 12 and the weights are movable vertically on guide rods 80 and 81 which are fastened at their upper ends with nuts 82 and at their lower ends by letting them extend into the spring containing tubes 83 which are mounted to floor plate 84. There are bumper springs 85 for the weights as in the previously discussed frames. The weights are carried on a carrier bar 86. The carrier bar has a pulley clevis 87 mounted to it and there is a pulley 88 rotatable in the clevis 87. As is most evident in FIGS. 2 and 3, there are two upper pulleys 89 and 90 mounted for rotation on a transversely extending brace member 91 and there is a rearmost upper pulley 92 also associated with the weight system for frame 12. Another pulley 93 involved in the system is mounted on a bracket 94 proximate to the floor plate 84. A cable 95 runs on pulleys 89, 90, 88, 92 and 93. The cable has a lower free end portion 96 which terminates in a handle 97 and an upper free end portion 98 which terminates in a handle 99. Handle 99 would be called a "lat bar" because it is used in exercises for developing the latissimus dorsi muscles. A bifurcated bracket 100 located immediately above floor plate 84 serves to stop the cable from simply being pulled off of the pulleys when an exercise is being performed in which a downward pull is exerted on the upper end portion 98 of the cable by means of handle 99. The cable must also be prevented from pulling off of the pulleys when an exercise is being performed in which a pulling force is exerted on lower free end portion 96 of the cable by pulling on lower handle 97. The stop for the upper portion 98 of the cable is not shown but the free end portion 98 could just yield, when a force is applied to the lower free end portion 96, until the handle 99 jams on pulley 89. Weights 79 are shown as being supported on the lowest weight in the stack since it is the lowest weight through which pin 71 is inserted to connect it to carrier bar 86.

For doing a rowing exercise, the person could sit on a mat, not shown, placed on the floor in front of center frame 12. The legs of the person would be extended, with knees slightly upwardly bent, toward frame 12. The lower handle 97 is then grasped with the left and right hands and pulled toward the exerciser so that the weights 79 rise and cause the cable and user's muscles to be stressed. Footrest means are provided at the center frame 12 to prevent the exerciser from being slid along the floor when attempting to raise the weights by pulling on the lower handle 97. The means for preventing sliding comprise a leg 105 on the left side of the frame 12 and another leg 106 on the right side. The lower end of leg 105 enters a bracket 107 mounted to the floor plate 84. Leg 105 is pivotally connected to bracket 107 so that leg 105 can swing down from its vertical or stored position as in FIG. 1 to a horizontal position, which is not shown, but wherein it presents for the feet of the exerciser a footrest pad 108. The right side leg 106 is also pivotable on a bracket 109 which is mounted to floor plate 84. This leg has a footrest pad 110 mounted on it. The right side footrest is shown in its active position in phantom lines in FIG. 2 wherein the leg is marked 106′ and the footrest pad is marked 110′.

When focusing attention on the structural details of the multipurpose fitness apparatus one should not lose sight of the fact that the invention resides in combining what may be considered substantially conventional weight lifting apparatuses in a new arrangement such that exercises which could only be done at one location by having access to a variety of free-standing weight lifting machines can now all be done with a single piece of equipment that occupies minimum floor space.

I claim:

1. Apparatus for improving physical fitness, comprising:

first and second generally rectangular vertically elongated end frame means having bases, respectively, for standing upright on a floor, said end frame means being spaced apart in a lateral direction, the end frame means having similar widths extending in a direction generally transverse to said lateral direction so as to define the narrow ends of an exercising area on the floor between said frame means, said area having a long front side and a rear side, said end frame means being disposed in vertical and generally transversely extending planes, at least two elongated generally horizontal structural members having corresponding ends fastened to the upper ends of the respective end frames to assist in stabilizing said frames in an upright condition, a stack of weights in each end frame and guide means for constraining said weights to move vertically, carrier means for said weights and pulley means mounted to said carrier means, other pulley means mounted proximate to the upper and lower ends of said frame means and cable means running on said pulley means and terminating in upper and lower end portions, corresponding end portions of said cable means, respectively, being positioned adjacent said laterally spaced apart end frame means and between said end frame means such that a user positioned intermediate of said end frame means can grasp and pull the cable end portion on the left of the user across the body of the user toward the right and can grasp and pull the cable end portion on the right of the user across the body of the user toward the left so the arms of the user can cross over to accomplish exercising of torso muscles, especially the latissimus dorsi muscles concurrently, a third generally rectangular vertically elongated frame means for standing upright on said floor substantially midway between said end frames and disposed in a vertically and laterally extending plane defining the rear of said exercising area, the upper end of said frame means being connected to at least one of said laterally extending structural members to stabilize said third frame means, a stack of weights in said third frame means and guide means for constraining said weights to move vertically, carrier means for said weights in said third frame means and pulley means mounted to said carrier means, other pulley means mounted proximate to the upper and lower ends of said third frame means and cable means running on said pulley means and terminating in upper and lower end portions which are accessible to an exercising user for applying a force to lift said weights in said third frame.

2. The apparatus according to claim 1 including:

legs adjacent opposite sides, respectively, of said third frame, said legs being mounted for pivoting about a laterally directed horizontal axis proximate to the lower end of said third frame, each leg having a footrest at a free end remote from said pivot axis, said legs being swingable between a generally vertical attitude in storage position adjacent said sides to a horizontal attitude for presenting said footrests toward the front of said apparatus.

* * * * *